United States Patent [19]

Lundquist et al.

[11] Patent Number: 4,457,431

[45] Date of Patent: Jul. 3, 1984

[54] STACKABLE DEFORMABLE-SIDE SOFT BOX

[75] Inventors: Burton R. Lundquist; Christopher P. DeCoster; both of Scottsdale, Ariz.

[73] Assignee: Armour Food Company, Omaha, Nebr.

[21] Appl. No.: 349,273

[22] Filed: Feb. 16, 1982

[51] Int. Cl.[3] ..... B65D 77/22

[52] U.S. Cl. ..... 206/491; 206/45.31; 229/16 R; 229/37 R; 229/39 R

[58] Field of Search ..... 206/45.31, 491; 229/6 R, 16 A, 16 R, 37 R, 37 E, 38, 39 R, 39 B

[56] References Cited

U.S. PATENT DOCUMENTS

| | | | |
|---|---|---|---|
| 627,868 | 6/1899 | Morgan | 229/38 |
| 1,830,246 | 11/1931 | Sanford | 206/491 |
| 2,067,998 | 1/1937 | Williamson | 229/16 R |
| 2,361,876 | 10/1944 | Schell | 220/463 |
| 2,361,877 | 10/1944 | Schell | 220/418 |
| 2,365,739 | 12/1944 | Williamson | 229/44 R |
| 2,619,226 | 11/1952 | Adams | 206/491 |
| 2,893,623 | 7/1959 | Bates | 229/39 B |
| 2,939,621 | 6/1960 | Mittleman | 229/39 R |
| 2,981,405 | 4/1961 | Grasty | 206/491 |
| 2,984,401 | 5/1961 | Herkender | 206/361 |
| 3,021,045 | 2/1962 | Morris | 229/37 R |
| 3,022,930 | 2/1962 | Kuchenbecker | 229/17 G |
| 3,695,508 | 10/1972 | Hocking | 229/38 |
| 3,820,707 | 6/1974 | Fischer et al. | 229/39 B |
| 3,946,936 | 3/1976 | Brown | 229/16 A |

FOREIGN PATENT DOCUMENTS

| | | | |
|---|---|---|---|
| 2802385 | 7/1979 | Fed. Rep. of Germany . | |
| 1289012 | 9/1972 | United Kingdom | 229/39 B |

*Primary Examiner*—George E. Lowrance
*Assistant Examiner*—Jimmy G. Foster
*Attorney, Agent, or Firm*—Willian, Brinks, Olds, Hofer, Gilson & Lione, Ltd.

[57] ABSTRACT

A box is disclosed which incorporates stiff ends and a flexible middle portion, which permits a number of such boxes to be stacked one-atop-another in a stable arrangement, while also permitting a person to manually feel the sectional shape of the housed product by applying compressive force at the edges of the box. The flexible middle portion is comprised of opposing pairs of apex-to-apex arcuate scores on the sides of the box so that compressive forces are localized at these arcuate scores. Each score has unscored regions between its termini and the adjoining edge of the box, so that the box tends to reform to its original shape when the compressive forces are released.

3 Claims, 5 Drawing Figures

STACKABLE DEFORMABLE-SIDE SOFT BOX

DESCRIPTION OF THE INVENTION

1. FIeld of the Invention

This invention relates to packages, and, more specifically, relates to a package particularly adapted for retail marketing sausages to the public.

2. Description of the Prior Art

In the past, boxes have been widely used to store, ship and merchandise various products. Included among such products were food items. Typically, the boxes were fabricated from paperboard. The boxes were normally rectangular in shape, with ends positioned at right angles with respect to the intervening sides. Such boxes offered several advantages: they stacked neatly; they were readily formed; and they facilitated the loading and unloading of over-pack containers.

A problem, however, was noted; the stiff nature of the conventional boxes prevented a manual examination of the shape of the product within. It was observed that consumers preferred to manually examine products which were expected to have an identifiable shape. Specifically, touch was observed to play a part in the selection of sausages, which were conventionally round in section. While an application of brute force could deform a conventional rectangular box to the shape of an enclosed round item, the required effort interfered with an evaluation of the item's shape. Simply crushing a box to manually inspect the contents created a risk that an over-zealous effort would also crush the product. Crushing a box for inspection purposes caused permanent deformation of the box, including the formation of irregular, unsightly creases. The permanent deformation, and unsightly creases, impaired the marketability of the previously "inspected" product.

The thickness or stiffness of the packaging material could be reduced to improve the "softness" or "feel" of a conventional paperboard box. The reduction, however, tended to defeat the shape-retaining structural parameters of the container, thereby increasing the risk that the contained product could be crushed when stacked or shipped. The lighter material was difficult to handle, and was not well suited to existing package forming machinery.

A need continued to exist for a package which was both sufficiently rigid so as to retain its shape and protect the product during packaging and shipping, but which was also sufficiently soft or flexible so as to permit a prospective purchaser to examine the sectional shape, softness and deformability of the packaged product without simultaneously destroying the product or permanently deforming the package.

SUMMARY OF THE INVENTION

It is an object to provide a stackable box with a softly deformable midsection.

It is another object to provide a box which is sufficiently flexible in a central region to permit a manual inspection of the sectional shape of the contained item without an accompanying destruction or permanent deformation of the box.

It is an object to provide a paperboard box which can be readily manually deformed at a central region, and which further has a resilient structure to substantially return the box to its original shape when released from a deforming force.

DESCRIPTION OF THE PREFERRED EMBODIMENTS

In accord with one embodiment of this invention, a stackable box having a manually deformable midsection is disclosed, comprising: first and second opposed ends; at least three sides lying parallel to a common axis and meeting one another at edges; the sides each having a meeting with each of the ends so that the ends tend to maintain the sectional shape of the box; and longitudinal arcuate scores on the sides of the box having their respective termini adjoining longitudinal edges of the box while leaving unscored regions between said termini and the adjacent edges of the box—permitting flexure without irregular creasing of the box when the edges are manually inwardly compressed, while imparting a tendency for the box to reform into its original shape when the compressive force is released.

In accord with another embodiment of this invention, a stackable box having a manually deformable midsection as described above is disclosed, further comprising a plurality of opposing pairs of apex-to-apex arcuate scores on the sides, giving the box enhanced flexibility.

In accord with a further embodiment of this invention, a stackable box is disclosed, having a glue flap connected to one of the sides of the box, comprising a number of individual tabs to minimize the stiffening effect of the double layer of material at the glued joint of the box.

The foregoing and other objects, features and advantages will be apparent from the following, more particular, description of the preferred embodiments of the invention, as illustrated in the accompanying drawings.

THE SPECIFICATION

Figure 1:
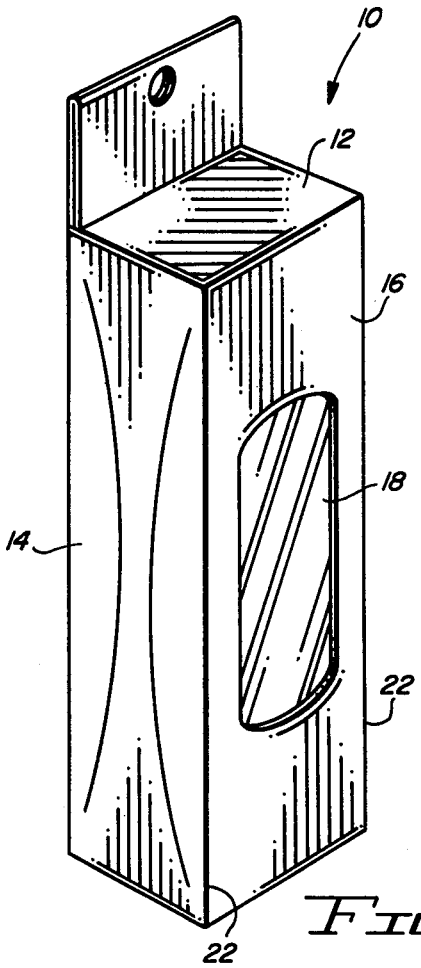
FIG. 1 is a perspective view of a first embodiment of a soft box.

In FIG. 1, a perspective elevational view of a soft, stackable box is shown generally by reference number 10. The box 10 has ends, a first of which is shown generally by reference number 12. The box 10 also has face panels or sides; a hinged panel 14 is shown, adjoining a front or window panel 16. The panels 14, 16 space apart the respective ends 12. In the illustrated embodiment, the window panel 16 includes a display opening 18, through which an observer can view the contents of box 10. The opening 18 is typically sealed with a transparent packaging material. The box 10 is readily fabricated from conventional packaging materials, such as bleached sulfate paperboard, coated with polyethylene.

Figure 2:
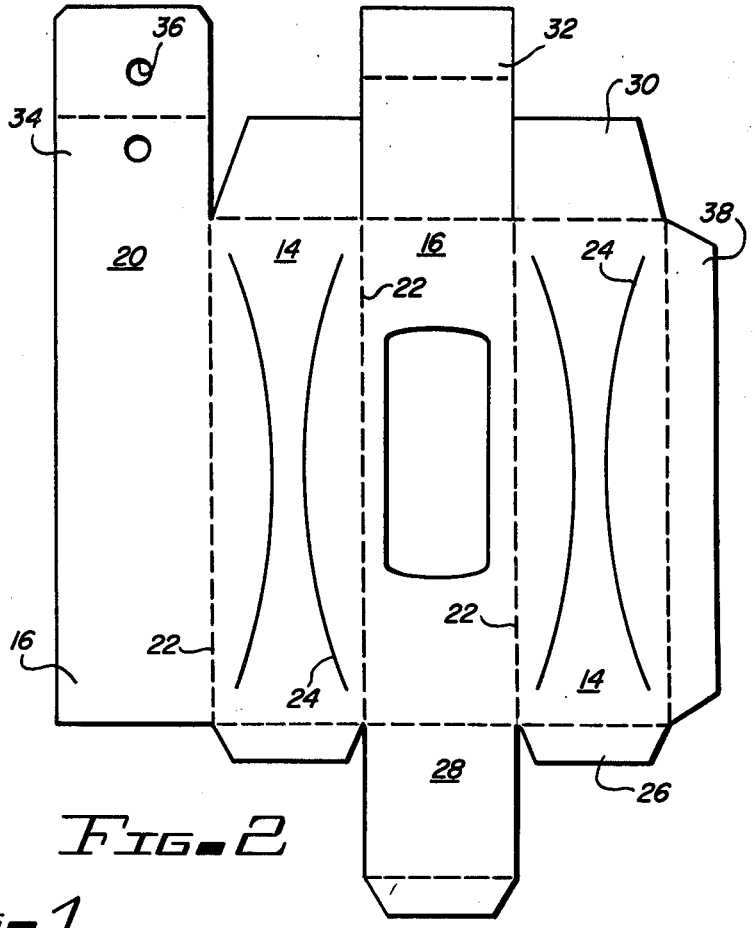
FIG. 2 is a view of a blank for the soft box of FIG. 1.

In FIG. 2, the box 10 of FIG. 1 is shown as a "blank", in an unfolded, pre-assembled condition. Clearly identified are each of the panels 14, 16, in addition to a back panel 20. The panels 14, 16 and 20 meet one another at longitudinal edges 22. The "hinge action" of each of the hinged panels 14 is provided by an opposed pair of apex-to-apex arcuate scores 24. The scores 24 approach, but do not reach, the corners defined by edges 22. The scores 24 permit, define and encourage flexure of the sides 14 when the mid-portions of the edges 22 of the assembled box 10 are pressed inward toward the enclosed object. In the illustrated embodiment, the window panel 16 and the back panel 20 are formed from unscored sheets of box material.

Tabs 26, and an endflap 28, combine to permit the lower end of the box 10 to be closed. Corresponding upper tabs 30 and an upper end flap 32 permit the top of the box 10 to be closed. When assembled, the ends of the box 10 are securely fastened together, as by gluing. A display hanger 34 extends from the upper end of the box 10. The display hanger is doubled over when the box 10 is assembled and defines a hole 36 to permit the box 10 to be suspended for display. A glue flap 38 is attached to one of the hinged panels 14. The glue flap 38 is subsequently bonded to another panel, for example the back panel 20, to assemble the box 10 as shown in FIG. 1.

When placed in use, an observer can manually detect the general shape of the enclosed item by squeezing the middle portion of the assembled box 10. The scores 24 permit flexure, and produce a box 10 which has an advantageous soft feel. In combination, the length, number and depth of the scores control the relative degree of softness of the box 10.

The unscored regions between the termini of each of the scores 24 and the adjoining edges 22, help re-form the box 10 to its original configuration when the center portion is released from a compressive force. Each of the end panels also acts as a diaphragm, maintaining the original configuration for the ends of the box 10.

Figure 3:
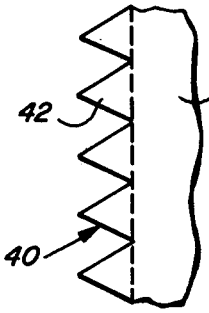
FIG. 3 is an enlarged view of a portion of an alternate embodiment for the edge-lap of the box of FIGS. 1 and 2.

FIG. 3 illustrates a segment of an alternate configuration for the glue flap, as identified generally by reference number 40. The alternate glue flap 40 utilizes a number of tabs 42 to minimize the stiffening which otherwise results from the double layer of material underlying the glued joint. In turn, this results in a softer, more readily deformable box 10.

Figure 4:
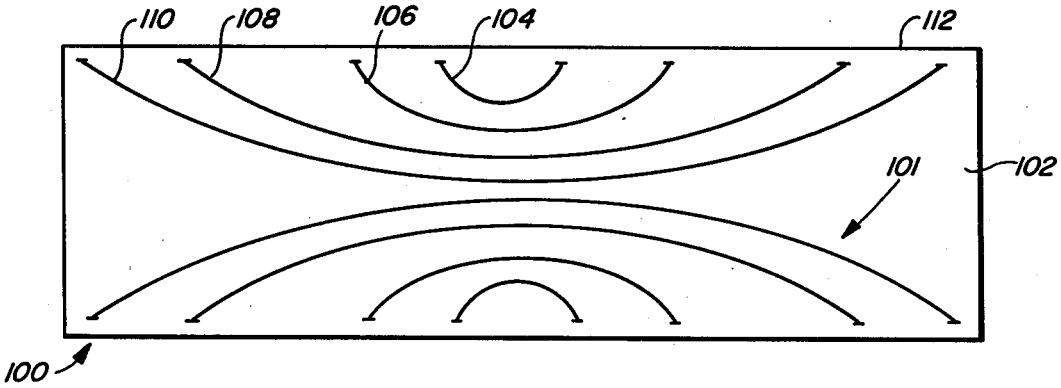
FIG. 4 is an elevational view of one side of an alternate configuration for a soft box.

FIG. 4 is an enlarged detail of one side of an alternate embodiment of the box, as shown generally by reference number 100. The box 100 employs a pattern of scores 101 upon a side panel 102. The individual pairs of scores in the pattern 101 are respectively identified by reference numbers 104, 106, 108 and 110. The similarly oriented scores are nested in an apex-to-apex configuration, with the individual scores of each pair facing in opposite directions. The pattern 101 is embossed or otherwise impressed on each of the respective sides 102 of the box 100. While the pattern 101 is shown as having four pairs of scores, it will be appreciated by those skilled in the art that any number of such scores could be employed to gain the practical advantages of this invention.

To maintain a maximum degree of resiliency, and thereby help to reform the original shape after the box 100 has been "felt", the termini of the respective scores 104, 106, 108, 110 only approach, and do not fully reach, adjoining edges 112. The unscored regions, between the edges 112 and the scores, cooperate with the ends of the box 100 to provide a "memory" to generally restore the box to its original shape after a good squeeze.

Figure 5:
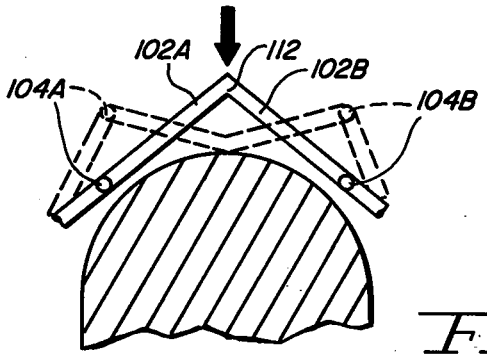
FIG. 5 is a schematic illustration of the hinge operation allowed by the scores on the sides of a box similar to that shown in FIG. 1, having arcuate scores on two adjacent sides of the box.

FIG. 5 is a sectional view taken through a corner of a box similar to the box 10, showing the manner in which the flexure is facilitated by scores 104A, 104B on adjacent side panels 102A and 102B of the box. The flexure is produced when force is applied to the edge 112 in the direction shown by the arrow. At rest, the edge 112 and the scores 104A, 104B reside in the position shown by the solid lines. When force is applied, as shown by the arrow, the respective panels 102A and 102B of the box 100 are deflected to allow the edge 112 to contact the contained product, as shown by the dashed lines. As the box 100 is manually deformed to permit detection of the shape of the enclosed item, the principal flexure occurs at the scores 104A, 104B.

The box 10, or 100, is fabricated by first preparing a blank as generally shown in FIG. 2. The scores 24 are stamped or otherwise impressed upon the blank. The blank is then formed into a rectangular container as shown in FIG. 1, and the product is loaded therein. The rectangular shape facilitates overpacking the box 10, 100 in a larger container for shipment. The box-product combination is then distributed, to be ultimately placed on retail display. A retail customer then has the surprising opportunity to manually inspect the sectional character of the product housed within the rectangular box, 10 or 100, without an accompanying unsightly permanent deformation of the box.

While the invention has been particularly shown and described with reference to preferred embodiments thereof, it will be understood by those skilled in the art that the foregoing and other changes in form and details may be made therein without departing from the spirit and scope of the invention.

We claim:

1. An elongated stackable box having a deformable midsection, comprising:

first and second opposed ends;

at least three sides lying parallel to a common axis and meeting adjoining ones of said sides at edges;

said sides having a meeting with each of said ends so that said ends tend to maintain the sectional character of said box;

at least one of said sides having a longitudinal arcuate score having its termini adjoining the adjacent edge of the box for permitting flexure without irregular creasing when the adjacent edge is inwardly compressed; and said arcuate score having unscored regions between its termini and the adjoining edge so that said box tends to reform to its original shape when the compressive force is released.

2. A stackable box in accord with claim 1, wherein a plurality of opposed pairs of nested apex-to-apex arcuate scores appear on at least one of said sides.

3. A stackable box in accord with claim 1, wherein a glue flap is provided comprising a number of individual tabs to minimize the stiffening effect of the double layer of material at the glued joint of said box.

* * * * *